US005195664A

United States Patent [19]

Rhea

[11] Patent Number: 5,195,664

[45] Date of Patent: Mar. 23, 1993

[54] ALL DIRECTIONAL FLUID PICK-UP

[76] Inventor: Steven Rhea, 553 County Road #3, Louisville, Colo. 80027

[21] Appl. No.: 862,790

[22] Filed: Apr. 3, 1992

[51] Int. Cl.[5] ..... B67D 5/40; B67D 5/60

[52] U.S. Cl. ..... 222/464; 222/382

[58] Field of Search ..... 222/382, 464, 211

[56] References Cited

U.S. PATENT DOCUMENTS

| | | | |
|---|---|---|---|
| 2,483,661 | 10/1949 | Neas | 222/464 UX |
| 2,920,798 | 1/1960 | Samuel | 222/464 X |
| 3,113,698 | 12/1963 | Abplanalp | 222/1 |
| 3,211,349 | 10/1965 | Prussin et al. | 222/394 |
| 3,547,296 | 12/1970 | Greenberg | 215/11 |
| 3,580,430 | 5/1971 | Angele | 222/394 |
| 3,631,880 | 1/1972 | Hansel | 137/172 |
| 4,273,272 | 6/1981 | Blanc | 222/464 |
| 4,830,235 | 5/1989 | Miller | 222/464 |
| 4,940,152 | 7/1990 | Lin | 215/11.5 |

FOREIGN PATENT DOCUMENTS

| | | | |
|---|---|---|---|
| 2136057 | 9/1984 | United Kingdom | 222/464 |

*Primary Examiner*—Kevin P. Shaver
*Attorney, Agent, or Firm*—Rost, Kyle W.

[57] ABSTRACT

A container with a discharge valve attached defines an interior volume containing a liquid. A rigid dip tube is connected between the valve and a flexible dip tube. This flexible dip tube, in turn, is attached to a weighted pick-up head. The pick-up head is formed of a buoyant portion and a weighted portion, such that the head is self-righting but does not float. A conduit, which may be continuation of the flexible tube, extends through the pick-up head to an inlet on the lower face of the head. The configuration of the head provides spacing between the inlet and the container walls such that the inlet always is in communication with the liquid.

17 Claims, 2 Drawing Sheets

ALL DIRECTIONAL FLUID PICK-UP

TECHNICAL FIELD

The invention generally relates to dispensing and more specifically relates to dispensing with an internally directed outlet pipe. The invention also specifically relates to processes of dispensing, as well as to dispensing with a discharge assistant, e.g., moveable trap, chamber, etc., including fluid pressure. In another aspect, the invention generally relates to fluid handling.

BACKGROUND

In the art of fluid handling and special dispensing devices, spray bottles and cans are widely used for many purposes. These types of containers offer a controlled atmosphere in which to contain liquids that might be activated in some manner or easily become dissipated upon exposure to atmosphere. Further, spray containers provide specially adapted dispensing nozzles so that the liquid is processed into an appropriate pattern according to its purpose. Thus, for example, paint can be stored for long periods without loss of solvent and then can be sprayed in an appropriate fan-shaped pattern; and plastic foams can be dispensed as a cohesive mass that then expands and solidifies only upon release from the container.

A common construction of a spray bottle or spray can employs a dip tube that depends into the liquid contents from a spray head at the top of the container. This tube is rigid and its operation requires that the spray container be held in a somewhat upright position, so as to keep the open lower, pick-up end of the tube immersed in liquid. If the container is tipped to far from upright or becomes inverted, the spray device ceases to operate due to the tube's drawing gas instead of liquid.

Variations from the use of rigid dip tubes are found in special applications. For example, when it is desired to extract liquid from the top of a contained reservoir, a partial rigid dip tube may extend from the spray head into the liquid, where a flexible tube is attached to a float that keeps the pick-up end of the flexible tube near the surface of the liquid pool. This teaching has been applied in U.S. Pat. No. 3,631,880 to extracting gasoline from a tank, when it is desired to avoid picking up sediment from the tank bottom. Similarly, U.S. Pat. No. 4,940,152 employs a float in a nursing bottle to maintain the pick-up end of a flexible tube near, but slightly below, the surface of the liquid regardless of the position of the bottle.

Another special application arises when two immiscible liquids are contained in surface contact in the same reservoir. Such liquid may need to be mixed upon dispensing from an aerosol container, or it may be desired to dispense only one of the two. In this case, the container may employ a flexible dip tube having on its end a float of selected density so as to float between the two layers of liquid. The float is provided with intakes leading into each layer to be dispensed, so as to extract from one or both layers during any spraying operation. This teaching is applied in U.S. Pat. No. 3,113,698 to extract from both layers and mix the two during spraying. In U.S. Pat. No. 3,211,349 only one layer is removed, leaving behind the other.

Other containers have had their liquid contents extracted by the use of a flexible dip tube coupled on its pick-up end to a weight. For example, in U.S. Pat. No. 3,547,296 a nursing bottle is equipped with such a liquid pick-up system in which a rigid tube is joined to a flexible end portion, thus allowing the flexible end to rest within the liquid contents regardless of the position of the bottle. A problem with this system is that the flexible portion tends to become pinched off near the juncture to the rigid portion. Consequently the patent proposes that the juncture be wound with a coil to prevent such pinching off. Another flexible dip tube with weighted free end is disclosed in U.S. Pat. No. 3,580,430. In this patent, the flexible tube is considerably longer than the height of the container so that the weighted end does not pull on the tube to cause a pinching off. U.S. Pat. No. 4,830,235 employs an articulated jointed siphon tube in a spray bottle, wherein the tube is formed with a plurality of rigid sections interconnected by pivotal joints, and the pick-up end of the tube is weighted and has legs. Study of this type of design shows that the tube can become tangled quite easily when the bottle is inverted and may not be able to return to original position when the bottle is righted. In addition, legs of the type shown in the patent can contribute to the tipping of the pick-up end and be detrimental to any self-righting ability. U.S. Pat. No. 4,273,272 employs a weighted end on a flexible pick-up tube, in which the tube end shows a clear tendency to lie on its side and not be self-righting. In addition, this design is functional only through a limited degree of bottle tilt.

Although these patents and others of similar scope have proposed various constructions that would enable a spray container to operate in different angular positions, there is no known commercial utilization of any of these constructions. Among the reasons for non-utilization may be high cost, difficulty of construction, and operational problems. In particular, the prior patented constructions do not have the ability to self-right. It appears that those with weights will lie on their sides when the bottle is tilted sideways, with the unfavorable result that it is not possible to pick-up low levels of liquid from the bottle. Due to the high cost and complex construction of these devices, it appears that manufacturing this type of invention will not be practical until a simpler, more efficient solution is found. It is in these areas of design, construction, and operation where there is an opportunity and need for improvement.

An all directional spray pick-up should offer self-righting capabilities and reliable construction with little chance for the pick-up device to become detached or otherwise inoperable. Also, the pick-up device should be efficient so that it is able to extract substantially the entire content of the container. Further, the pick-up device should be of a simple design that is inexpensive to manufacture. It is in these areas of potential improvement that the present invention is directed.

To achieve the foregoing and other objects and in accordance with the purpose of the present invention, as embodied and broadly described herein, the all directional fluid pick-up and method of operation of this invention may comprise the following.

DISCLOSURE OF INVENTION

Against the described background, it is therefore a general object of the invention to provide an improved all directional fluid pick-up in which the pick-up head is self-righting.

Another object is to provide a pick-up head that operates in any direction while maintaining free communication with the liquid contents of a spray bottle or aerosol can.

Still another object is to provide an all directional fluid pick-up in which the pick-up head is self-righting regardless of the shape of the bottle and regardless of the position of the bottle.

A further object is to provide an all directional fluid pick-up in which the pick-up head does not tend to pinch off the flexible tube to which it is attached. Accordingly, certain embodiments of the pick-up head are specially adapted to prevent twisting of the flexible tube.

Still another object is to provide an all directional fluid pick-up that is of simple design and that is inexpensive to manufacture.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, an all directional fluid pick-up is adapted for use with a container that defines an interior volume capable of containing a liquid of known specific gravity. A valve such as a pump spray head of aerosol spray head, which is capable of selectively opening and discharging liquid from the interior volume of the container, is provided. A rigid dip tube has a first end connected to the valve and has a second end extending from the valve and locatable, in use, into the interior volume of the container. A flexible dip tube has a first end connected to the second end of the rigid dip tube and also has an opposite, second end. A pick-up head is connected to the second end of the flexible dip tube. This pick-up head is formed of first and second portions, wherein the first portion has lower density than the second portion such that, in use, the first portion is buoyant within the liquid and exerts a self-righting influence on the pick-up head as a whole. The second portion has sufficiently high density that, in use, the pick-up head as a whole is non-buoyant within the liquid. The pick-up head is joined to the flexible dip tube near the first portion. A conduit is carried by the pick-up head and extends through the first and second portions of the pick-up head. This conduit has a first end connected to the flexible dip tube near the first portion of the pick-up head and has a second end forming an inlet housed in the second portion of the pick-up head at a position substantially opposite from the first portion, for, in use, receiving and transmitting liquid through the pick-up head to the flexible dip tube and to the valve.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

Figure 1:
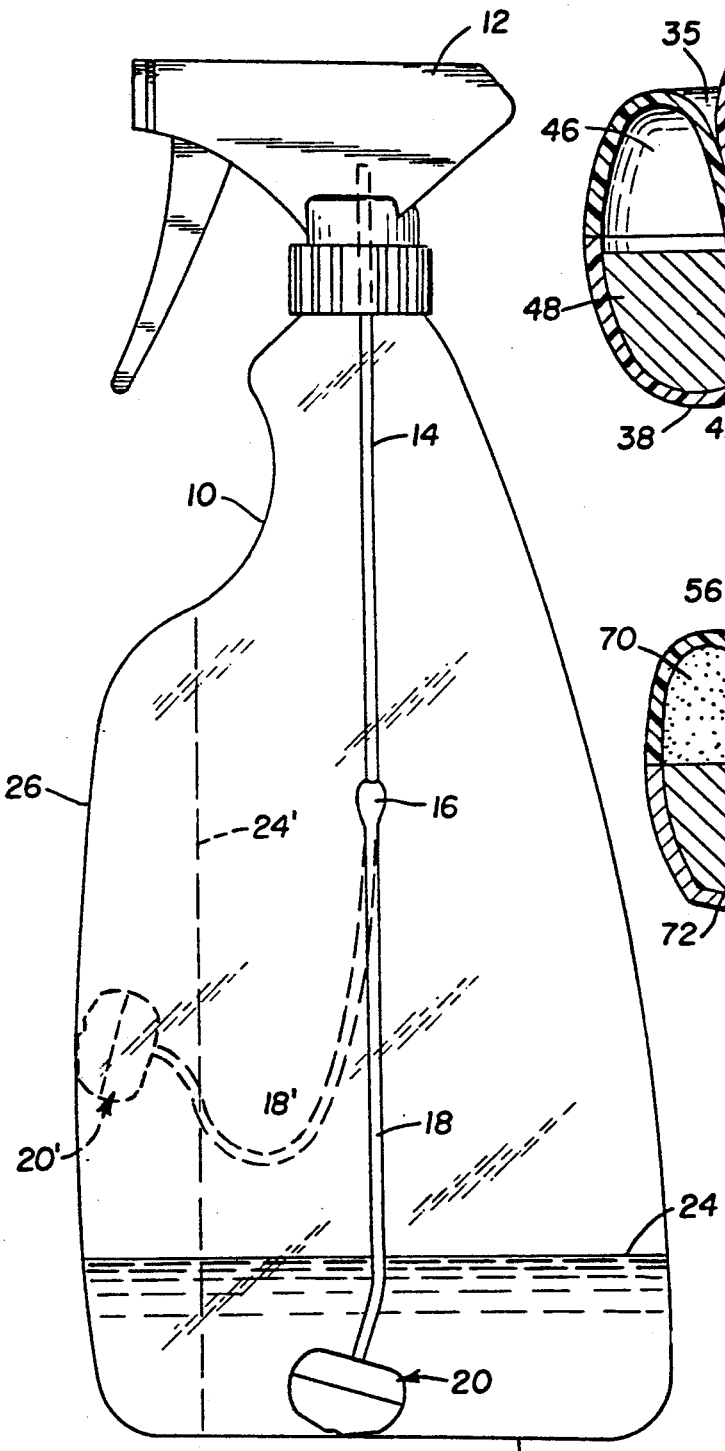
FIG. 1 is a side elevational view of a spray bottle embodying the invention, with the bottle and pick-up first shown in upright position and shown in phantom in ninety degree tilted position.

An all directional fluid pick-up according to the invention may be applied to any variety of pump spray bottle 10 such as that shown in FIG. 1. This type of bottle 10 conventionally is closed by a leak proof pump spray head 12. The bottle and head are suited to accommodate a predetermined liquid contents, and, accordingly, the materials of construction, orifice design, and other details of pump construction may be adapted to the intended use.

The mechanism of the invention may include a length of straight, rigid dip tube 14 joined at its upper end, in the arrangement of FIG. 1, to the inlet of the pump spray head 12. The lower end of tube 14 constitutes a mini-barb 16, suited for attaching a flexible dip tube. The length and materials of construction in the tube 14 may vary according to the size of the bottle 10 and the nature of the liquid contents. Typically, the tube 14 is constructed of nylon or polypropylene and is less than one-half the length of bottle 10. Instead of a rigid dip tube, the pump spray head 12 may be provided with other connecting means for attachment of a flexible tube. Such connecting means could include an integral tube barb, a bore into which a flexible tube is inserted, or a tube clamp.

A flexible dip tube 18 is attached at one end to the dip tube 14, at integral mini-barb 16, so as to suspend the tube 18 from tube 14. Materials of construction suitable for flexible tube 18 include silicone, polyurethane, latex rubber, vinyl or teflon. The length of the flexible tube 18 is greater than one-half the height of bottle 10 so as to be able to reach substantially any part of the bottle's interior. This flexible tube 18 carries a weighted pick-up head at its lower end. As shown in FIG. 1, the weighted pick-up head 20 can rest against a bottom wall of the bottle regardless of the position in which the bottle is held. When the bottle is upright as shown in solid lines, the flexible tube may be substantially straight, carrying the pick-up head against the normal bottom panel 22 of the bottle 10, immersed in pool 24 of liquid contents. However, if the bottle is tipped to one side, such as to its left from the position shown in FIG. 1, the flexible tube and pick up head assume the positions shown in phantom in FIG. 1. Additional degrees of tilt, to and including full inversion, produce equivalent displacement of the head to follow the pool of liquid in the bottle under force of gravity. Thus, the flexible dip tube is displaced into a curve and the pick-up head 20 then rests within pool of liquid 24', against former side wall 26 of the bottle, which then serves as a temporary bottom wall.

Figure 2:
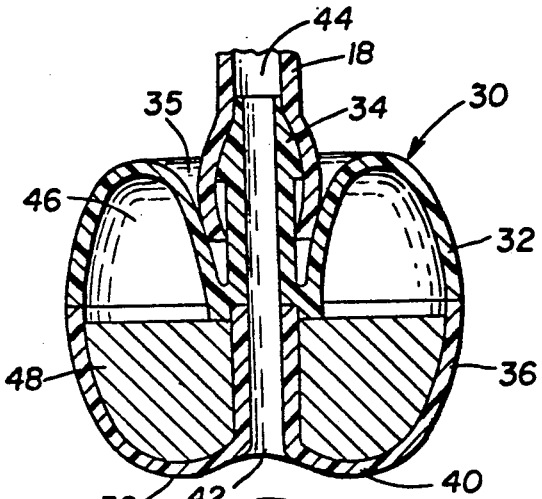
FIG. 2 is an enlarged vertical cross-sectional view of a first embodiment of a weighted pick-up.

The pick-up head may have any of several configurations. In the configuration of FIG. 2, the head generally is designated as 30. An airtight shell formed in top and bottom halves surrounds the head, and the top half 32 also defines an integral connection barb or mini-barb 34, extending upwardly from the center of the head. The flexible tube 18 is attached to the head at this mini-barb 34. The mini-barb is at least partially recessed into a central cavity 35 so that the attached end of the flexible tube is laterally pinched between the cavity wall and the barb, to aid in retention and maintain a low center of gravity. This shell half is formed of hard, smooth, high impact plastic. The bottom shell half 36 is tightly joined or fused to the top half and is formed of similar material. An approximately flat lower face 38 of the bottom half of the shell defines a plurality spacers 40 evenly spaced about the perimeter of the lower face. Between spacers 40, the lower face of the shell defines substantial residual open areas that serve as passageways for transmission of the liquid contents of a spray bottle between the wall of the spray bottle and the lower face of the shell. In the center of the lower face, the shell forms an intake opening 42 with a continuous passageway 44 extending upwardly through mini-barb 34.

Within the two halves of the shell, the head is structured to be self-righting. The interior 46 of the top half of the shell is substantially hollow for buoyancy, while the bottom half of the shell contains a weight 48 formed, for example, of stainless steel, plastic or coated metal. Due to this internal structure, the head will lie with lower face 38 always on the bottom. The intake opening 42 is maintained in the liquid contents of the spray bottle, separated from the bottom wall of the spray bottle by only the height of spacers 40, which may be, for example, 1/32 inch. Consequently, this head will remove substantially all liquid from the spray bottle, regardless of the angle at which the bottle may be inclined.

Figure 3:
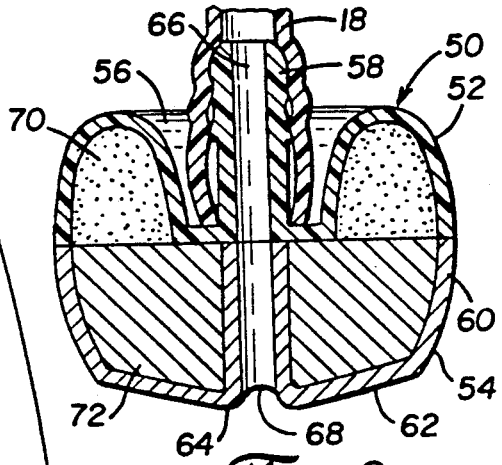
FIG. 3 is an enlarged vertical cross-sectional view of a second embodiment of a weighted pick-up.

In the embodiment of FIG. 3, the head generally is designated as 50. Its surface is defined by an airtight shell formed of a top half 52 and bottom half 54. As previously described, the top half is configured with a top central cavity 56 from which a hose barb 58 extends upwardly and is attachable to flexible tube 18. The bottom half of the shell has a lateral wall 60 that depends from the top half and converges into a frusto-conical bottom wall 62, acutely angled, for example, at thirty degrees from horizontal as viewed in FIG. 3. At the center of bottom wall 62 the shell defines intake opening 64, which is at the mouth of an intake tube 66. This tube communicates through the head and hose barb 58 to enable liquid to be transmitted to flexible tube 18. Transverse to tube 66 and crossing opening 64, the shell defines an inverted channel 68 that assures liquid access into tube 66. Thus, the head may rest on a side portion of surface 62, which will raise an opposite side edge of opening 64 to permit liquid access. Alternatively, it is possible that the head will rest squarely on the edges of opening 64, in which case the channel 68 permits liquid access.

Head 50 is self-righting to assure that intake opening 64 remains adjacent to the bottom of the spray bottle. Top shell portion 52 may be filled with foam plastic 70, such as styrofoam or a closed cell foam, for buoyancy. The bottom portion 54 may be contain a weight 72 formed of dense material such as, for example, metal or coated metal. A further feature of this head is that the shape produces less friction with the sides of the spray bottle, as compared to head 30.

Figure 4:
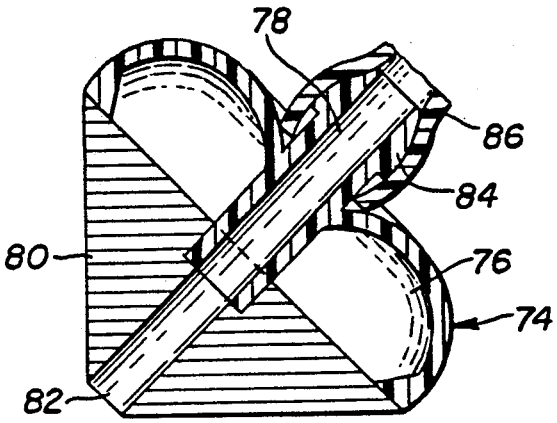
FIG. 4 is an enlarged vertical cross-sectional view of a third embodiment of a weighted pick-up.

In the embodiment of FIG. 4, the head generally is designated as 74. The construction of this head comprises a top and bottom portion joined together at an airtight, chemical resistant junction. The top portion 76 comprises a single airtight plastic or foam piece that at least partially defines a central passageway 78 passing downwardly through the head. If formed of plastic, top portion may be a hollow shell, or if formed of foam, the top portion may, for example, be formed of a piece of styrofoam. The bottom portion 80 comprises a weight such as stainless steel and is frusto-conical in shape with approximately a ninety degree or greater cone angle, with the result that the lower inlet opening 82 of passageway 78 constantly lies in a position where, in use, it would be exposed to the contents of a bottle and be capable of receiving liquid.

The passageway 78 is defined in part by a tube connection barb device 84 capable of being telescoped into a flexible tube 86 on the free end of the barb. The top shell 76 with its integral barb can be joined to the bottom portion 80 by being snapped, screwed, or set in. The lower end of the barb, as viewed in FIG. 4, may joined to the bottom portion of the head by being fused, such as by heat fusing or glue.

Figure 5:
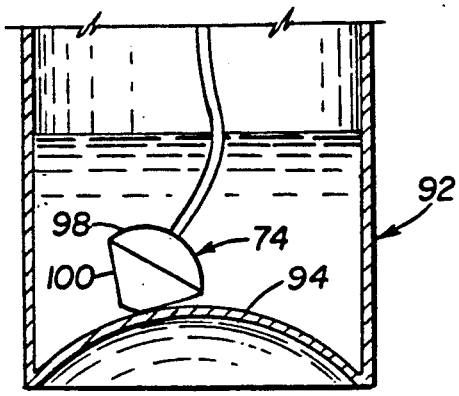
FIG. 5 is a vertical cross-sectional view of the bottom portion of an aerosol container.

The self-righting heads of this invention may be used in both spray bottles and aerosol spray cans. FIG. 5 shows a typical cut away section of an aerosol spray can 92 having a domed bottom wall 94. Within such an aerosol can, a head such as 74 may be used, having an airtight, buoyant upper portion 98 and weighted lower portion 100 similar to those previously described. The cone angle of the lower portion 100 is less than ninety degrees, which better enables the apex of the cone to enter the volume at the margins of the domed bottom 94.

Figure 6:
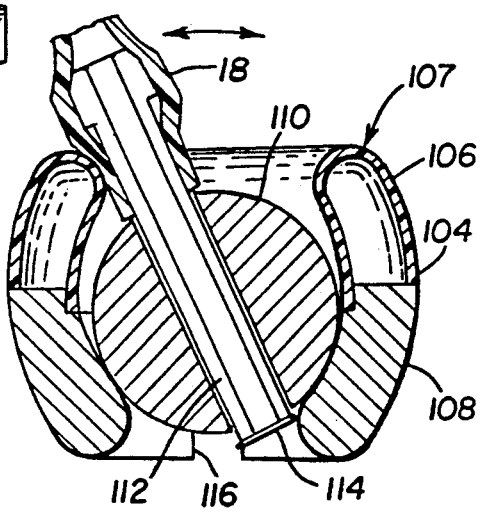
FIG. 6 is an enlarged vertical cross-sectional view of a fourth embodiment of a weighted pick-up.

Still another variation of the head is found in FIG. 6, wherein head 107 is a two part structure. The first part is a toroidal housing 104 having buoyant upper portion 106 and weighted lower portion 108. The weighted portion may be formed of plastic, coated metal, or stainless steel; while the buoyant portion may be formed of a plastic shell defining a hollow, airtight interior space. Within the center of the toroidal housing 104 is contained a ball or sphere 110 formed of relatively dense material such as plastic, coated metal, or stainless steel. A hose-barb 112 passes through the sphere 110 diametrically and extends above the toroidal housing from the buoyant upper end, where it is attached by its upper end to flexible tube 18. The ball 110 with its hose-barb is free to rotate within the housing 104. Contact between the upper end of the hose-barb and the upper edge of the housing limit the range of the ball's rotation. By this limitation, the lower, intake end of the hose-barb, as defined at lip 114, is prevented from moving into the housing and, thus, being blocked in its ability to pick-up liquid from under the housing. One or more lateral passageways 116 are formed in the bottom edge of the housing to further ensure that liquid can reach the pick-up end of the hose-barb. In operation of head 107, it is intended that housing 104 remain substantially upright at all times, while the ball 110 tilts and rotates as necessary within the housing.

Figure 8:
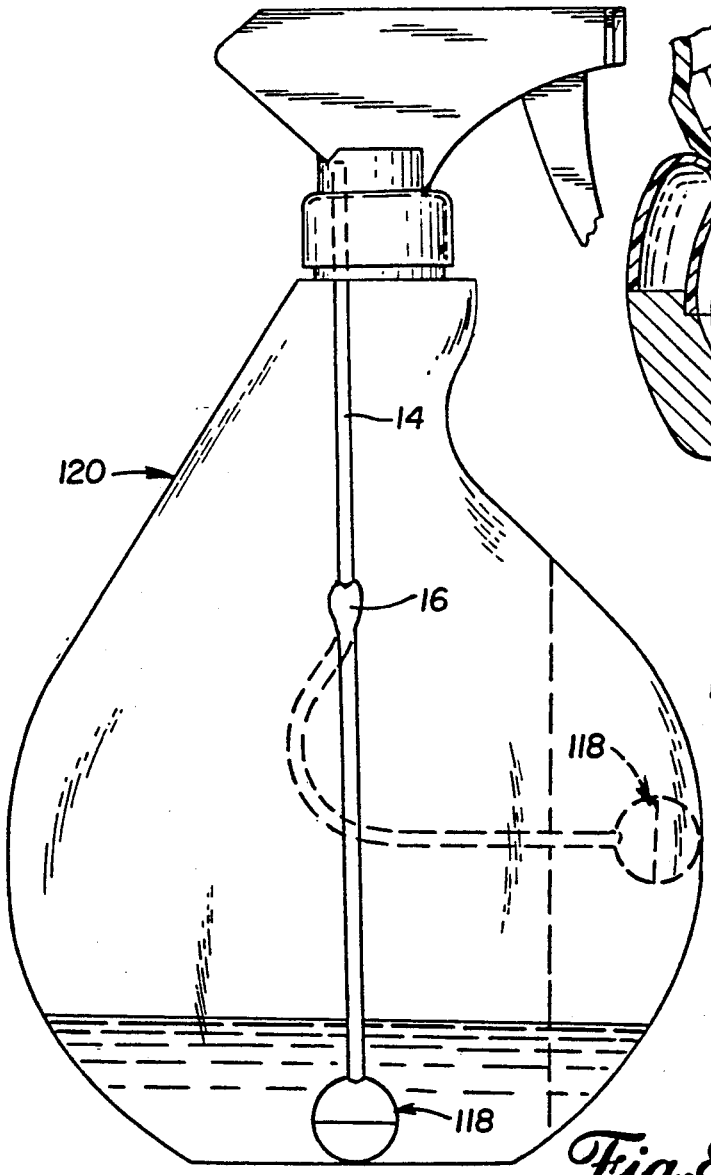
FIG. 8 is a vertical elevational view of a specially configured spray bottle embodying the invention.
Figure 7:
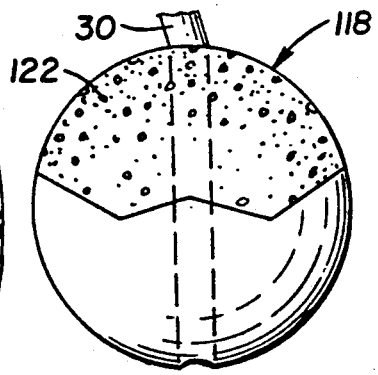
FIG. 7 is an enlarged perspective cut-away view of a fifth embodiment of a weighted pick-up.

Finally, FIGS. 7 and 8 show a combination of a weighted pick-up head 118 and a specially configured spray bottle 120. The head is self-righting due to the interaction of the two. The head may be constructed of top and bottom portions with the top portion 122 being formed of foam and the bottom portion 124 of a dense material, such as stainless steel, plastic or coated metal. Together, these portions are configured in the shape of a sphere. A flexible tube 18 is attached through the sphere for receiving liquid.

The configuration of bottle 120 allows the simple design of FIG. 7 to be self-righting in all positions. The rigid tube 14 is attached to a pump spray head 12 as described above. The flexible tube is attached to an integral mini-barb 16 on the lower end of the rigid tube, which becomes a pivot point for the flexible tube and weighted head 118. The mini-barb 16 is located slightly above the vertical center of the bottle, with the result that the flexible tube is slightly longer than the rigid tube. As a result of the length difference, the flexible tube remains open for fluid passage even when the bottle is inverted. In addition, the bottle is quite round in shape, which allows for the simple, round shape of its pick-up device.

In operation, each of the pick-up heads disclosed in all of the embodiments is self-righting so that the intake opening is face down, within the liquid in the spray bottle, regardless of the position in which the bottle may be held and regardless of the shape of the bottle. The pump in the spray head of pump spray bottles, or the pressure in aerosol cans, always is effective to cause available liquid from within the container to pass into the intake opening, through the flexible dip tube and rigid dip tube, and out the nozzle. Certain heads may be better suited for use in particular shapes of bottles or cans, and the buoyancy and mass of the weights in the head can be relatively adjusted to accommodate liquids of different viscosities. In addition to the advantage of allowing a spray container to be used in any position, the head also is an aid to mixing the contents of a spray container, such as a paint can.

The foregoing is considered as illustrative only of the principles of the invention. Further, since numerous modifications and changes may readily occur to those skilled in the art, it is not desired to limit the invention to the exact construction and operation shown and described or to the various combinations of materials that have been suggested, and accordingly all suitable modifications and equivalents may be regarded as falling within the scope of the invention as defined by the claims that follow.

I claim:

1. An all directional fluid pick-up, adapted for use with a container defining an interior volume capable of containing a liquid of known specific gravity and having a valve means on the container capable of selectively opening and discharging liquid from the interior volume of the container, wherein the fluid pick-up comprises:

a flexible dip tube;

a connecting means for, in use, connecting the valve means with a first end of said flexible dip tube;

a pick-up head connected to the flexible dip tube, wherein the pick-up head is formed of first and second portions, the first portion is of lower density than the second portion such that the first portion is adapted, in use, to be buoyant within the liquid and exert, a self-righting influence on the pick-up head as a whole, and the second portion is of sufficiently high density that, in use, the pick-up head as a whole is non-buoyant within the liquid; and a conduit means carried by the pick-up head, extending through the first and second portions of the pick-up head, connected to the flexible dip tube near the first portion of the pick-up head and having an end forming an inlet housed in said second portion of the pick-up head at a position substantially opposite from said first portion, for, in use, receiving and transmitting the liquid through the pick-up head to the flexible dip tube and, in use, to said valve means.

2. The all directional fluid pick-up of claim 1, wherein said first portion of the pick-up head comprises a shell defining a hollow internal volume.

3. The all directional fluid pick-up of claim 1, wherein said first portion of the pick-up head comprises a shell defining an internal volume, and said internal volume contains a foam plastic material.

4. The all directional fluid pick-up of claim 1, wherein said first portion of the pick-up head comprises a shell defining an internal volume, and said shell is airtight.

5. The all directional fluid pick-up of claim 1, wherein said second portion of the pick-up head comprises a shell defining an internal volume, and said internal volume contains a metal weight.

6. The all directional fluid pick-up of claim 1, wherein said second portion of the pick-up head is configured in a toroidal shape defining a central area housing said conduit means.

7. The all directional fluid pick-up of claim 6, wherein said second portion of the pick-up head defines a base wall having a plurality of spacers extending downwardly therefrom and housing said inlet therein, and, in use against an underlying surface, spacing the inlet from contact with the underlying surface.

8. The all directional fluid pick-up of claim 1, wherein said second portion of the pick-up head defines a frusto-conical base wall housing said inlet at the apex thereof.

9. The all directional fluid pick-up of claim 8, wherein said frusto-conical base wall further comprises a channel transverse to the inlet for, in use against an underlying surface, providing sure access to the inlet regardless of the position of the base wall against the underlying surface.

10. The all directional fluid pick-up of claim 1, wherein said pick-up head defines a central passageway extending therethrough; and said conduit means comprises a longitudinally elongated tube receivable within said passageway and relatively rotatable with respect to the pick-up head on a longitudinal axis, such that the pick-up head can roll with respect to the conduit means without imposing substantial twisting force on said flexible dip tube.

11. The all directional fluid pick-up of claim 10, wherein said conduit means further comprises a generally spherical body attached thereto and receivable within said central passageway of the pick-up head, said spherical body being pivotable within the passageway and permitting the conduit means to pivot with respect to the pick-up head; and wherein a portion of the conduit means extends upwardly from the passageway and is laterally engageable with the mouth of the passageway, thereby limiting the degree of pivoting of the conduit means with respect to the pick-up head.

12. The all directional fluid pick-up of claim 10, wherein said conduit means comprises an end portion of said flexible dip tube.

13. The all directional fluid pick-up of claim 1 wherein said first portion of the pick-up head comprises a buoyant foam.

14. The all directional fluid pick-up of claim 1, wherein said second portion of the pick-up head comprises a metal weight.

15. The all directional fluid pick-up of claim 1, wherein said connecting means comprises a rigid dip tube having a first end connectable, in use, to the valve means and having a second end extendable, in use, from the valve means into the interior volume of the container.

16. An all directional fluid pick-up, comprising:

a container defining an interior volume capable of containing a liquid of known specific gravity;

a valve means on said container capable, in use, of selectively opening and discharging liquid from the interior volume of the container;

a rigid dip tube having a first end connected to the valve means and having a second end extending from the valve means into the interior volume of the container;

a flexible dip tube having a first end connected to said second end of the rigid dip tube and having a second end;

a pick-up head connected to said second end of the flexible dip tube, wherein the pick-up head is formed of first and second portions, the first portion having lower density than the second portion such that the first portion is adapted, in use, to be buoyant within the liquid and exert a self-righting influence on the pick-up head as a whole, and the second portion has sufficiently high density that, in use, the pick-up head as a whole is adapted to be non-buoyant within the liquid; the pick-up head being joined to the flexible dip tube near said first portion; and a conduit means carried by said pick-up head, extending through the first and second portions of the pick-up head, the conduit means having a first end connected to said flexible dip tube near the first portion of the pick-up head and having a second end forming an inlet housed in said second portion of the pick-up head at a position substantially opposite from said first portion for receiving and transmitting said liquid through the pick-up head to the flexible dip tube and, in use, to said valve means.

17. An all directional fluid pick-up, comprising:

a container defining an interior volume containing a liquid of known specific gravity;

a valve means on said container capable of selectively opening and discharging said liquid from the interior volume of the container;

a rigid dip tube having a first end connected to the valve means and having a second end extending from the valve means into the interior volume of the container;

a flexible dip tube having a first end connected to said second end of the rigid dip tube and having a second end;

a pick-up head connected to said second end of the flexible dip tube, wherein the pick-up head is formed of first and second portions, the first portion having lower density than the second portion such that the first portion is buoyant within said liquid and exerts a self-righting influence on the pick-up head as a whole, and the second portion has sufficiently high density that the pick-up head as a whole is non-buoyant within said liquid; the pick-up head being joined to the flexible dip tube near said first portion; and a conduit means carried by said pick-up head, extending through the first and second portions of the pick-up head, the conduit means having a first end connected to said flexible dip tube near the first portion of the pick-up head and having a second end forming an inlet housed in said second portion of the pick-up head at a position substantially opposite from said first portion for receiving and transmitting said liquid through the pick-up head to the flexible dip tube and to said valve means.

* * * * *